US006119707A

United States Patent [19]

Jordan

[11] Patent Number: 6,119,707

[45] Date of Patent: Sep. 19, 2000

[54] OCTOSQUIRT POOL SWEEP CLEANER

[76] Inventor: Ginger Jordan, 220 Hickory Island, Merritt Island, Fla. 32953

[21] Appl. No.: 09/100,505

[22] Filed: Jun. 19, 1998

[51] Int. Cl.[7] ..... E04H 4/16

[52] U.S. Cl. ..... 134/93; 134/167 R; 4/490; 15/1.7; 422/264; 422/266

[58] Field of Search ..... 15/1.7; 4/490; 134/167 R, 168 R, 93; 239/229, 315; 422/264, 266

[56] References Cited

U.S. PATENT DOCUMENTS

| | | | |
|---|---|---|---|
| 2,982,971 | 5/1961 | Garaway | 15/1.7 X |
| 3,146,783 | 9/1964 | Aultman | 134/168 R |
| 3,261,371 | 7/1966 | Vernon | 134/168 R |
| 3,315,692 | 4/1967 | Arneson | 134/167 R |
| 3,512,540 | 5/1970 | Hughes | 134/167 R |
| 3,570,017 | 3/1971 | Reece | 134/168 R |
| 3,820,172 | 6/1974 | Kane | 134/168 R X |
| 3,872,533 | 3/1975 | Proffit | 15/1.7 |
| 4,041,563 | 8/1977 | Steeves | 15/1.7 |
| 4,178,949 | 12/1979 | Mazon, III | 134/167 R |
| 4,282,893 | 8/1981 | Kane | 134/167 R |
| 4,356,582 | 11/1982 | Stephenson | 15/1.7 |
| 4,429,429 | 2/1984 | Altschul | 15/50.1 |
| 4,503,874 | 3/1985 | Norton | 134/167 R |
| 4,651,377 | 3/1987 | Staples | 15/1.7 |
| 4,839,063 | 6/1989 | Brooks | 210/780 |
| 5,133,381 | 7/1992 | Wood et al. | 422/264 X |
| 5,195,563 | 3/1993 | Brooks | 138/103 |
| 5,350,508 | 9/1994 | Van der Watt | 210/169 |
| 5,383,975 | 1/1995 | Faxon | 134/22.11 |
| 5,454,940 | 10/1995 | Lakotish | 210/169 |
| 5,901,906 | 5/1999 | Bouldin | 134/167 R X |

*Primary Examiner*—Mark Spisich
*Attorney, Agent, or Firm*—Brian S. Steinberger; Law Offices of Brian S. Steinberger

[57] ABSTRACT

A swimming pool cleaning device powered by pressurized water running into the pool from an outlet jet port connected to the pool pump. The device has two hose sections, the first being approximately one foot is screwed into the outlet jet port. Attached to an opposite end is a swivel connector which is connected to a second hose that is approximately as long as the pool itself. The second hose has floats positioned along the exterior and wear rings for protecting the hose from wear and tear effects from using the apparatus. Attached to the second hose is a cleaning head having angled through-hole exit ports, which when water is flowing through the hoses causes the head and second hose to rotate relative to the first hose. Second and third versions include using brush sleeves over hose or rings and the cleaning head. A cage having a chlorine table can be located in the head. During operation, the head and hoses go in a sweeping pattern across the bottom and side surfaces of the pool, so that the brushes rotate and scrub those surfaces. The constantly moving hoses and head further agitate the water causing debris to move towards the pool skimmer and drain, which increases the efficiency of filtering all pool water and debris from walls and bottom surfaces. By keeping debris and sediment agitated and the chlorine water throughly mixing, the device provides a significant reduction of pool pump running time of between approximately two to approximately five hours, depending on the size of the pool.

4 Claims, 3 Drawing Sheets

OCTOSQUIRT POOL SWEEP CLEANER

This invention relates to swimming pools, and in particular to a rotating brush apparatus that attaches to a water outjet of a swimming pool for cleaning and brushing off the sides and bottom surfaces of the pool, and can also selectively release chlorine, and the like, into the pool.

BACKGROUND AND PRIOR ART

Underground swimming pools traditionally use side skimmers and/or side and/or bottom drains to allow outflowing water from the pool to be cleaned of floating debris. Typically, the skimmer and/or the pool pump areas use filter type baskets to collect the debris removed from the pool. However, these current systems only work if the debris is already floating in the pool water in the vicinity of the skimmers and drains. These current systems do not agitate the water in order to move debris toward the skimmers and drains. Furthermore, these current systems do not brush against the sides nor the bottom of the pool. Typically, when a pool is cleaned, the sides and bottom must be manually swept by a brush and the debris manually pushed to the drain. This manual type of brush cleaning is both expensive in time and manpower.

Numerous patents have been proposed to automate some of the cleaning requirements presented above. However, none of the patents adequately solves the problems presented above. Floating type skimming devices such as U.S. Pat. No. 5,350,508 to Van der Watt; U.S. Pat. No. 5,454,940 to Lakotish; and U.S. Pat. No. 4,503,874 to Norton, describe stationary large bulky and unsightly skimming cleaners that float on the surface of the pool and do not clean side walls nor bottom surfaces.

U.S. Pat. No. 4,282,893 to Kane; and U.S. Pat. No. 4,839,063 to Brooks describe nozzle end hoses connected to pool water jets. Since neither device uses brushes, they are incapable of directly cleaning side-wall and bottom surfaces.

U.S. Pat. No. 4,041,563 to Steeves; U.S. Pat. No. 4,356,582 to Stephenson; U.S. Pat. No. 4,429,429 to Altschul; and U.S. Pat. No. 4,651,377 to Staples describe attaching brushes to hoses that are in turn connected to pool inlet jets. However, the brushes are fixed to the hoses and thus can only rub against interior pool surfaces in one direction and do not allow for rotating the brushes against the surfaces. These devices are further limited to selected areas within reach of their weighted down components.

U.S. Pat. No. 3,261,371 to Vernon describes a swimming pool cleaning system that says it can dislodge sediment from the walls and floor of a swimming pool, column 1, lines 8–10. However, the Vernon device requires anchoring the tubing system on the pool floor by a weight, column 2, lines 25–27, which would inherently limit the reach of the cleaning device from adequately covering all areas that are desired to be cleaned.

U.S. Pat. No. 3,872,533 to Proffit describes a swimming pool cleaner with a rotary scrubbing brush connected to a pool's water jets. However, the Proffit device primary cleans the pool bottom surfaces and side walls areas since the device stays "in close proximity to the bottom surfaces of the pool throughout a majority of the period of its operation", column 2, lines 3–6. U.S. Pat. No. 5,383,975 to Faxon describes a similar device to Proffit that is used for pipelines.

In addition to the limitations described above, none of the prior art devices cited allow for releasing any chlorine chemicals in the pool during their operation.

SUMMARY OF THE INVENTION

The first objective of the present invention is to provide a device for swimming pools that uses water inlet jets to clean side-walls, and bottom surfaces of the pool while simultaneously agitating the water so that standard pool skimmers and filters become more effective.

The second object of this invention is to provide a cleaning device for swimming pools that takes up little space in the pool, is safe for swimmers and also entertains users of the pool.

The third object of this invention is to provide a rotating brush cleaning device for swimming pools connected to a water jet inlet that additionally releases chlorine within the pool.

The fourth object of this invention is to provide a cleaning device for swimming pools which moves the chlorinated water throughout the entire pool so there are no "dead spots" within the pool itself.

The fifth object of this invention is to provide a cleaning device attachment for a pool that enhances pool water circulation resulting in a cost savings of running standard powered pool pumps half the time.

A preferred embodiment of the sweep cleaning apparatus for swimming pools includes a threaded connector for attaching a hose to a water outlet jet port in a swimming pool having a drain, side-walls and a bottom surface, means for causing the hose to swivel, and a cleaning head having forty-five degree angled through-hole exit ports, wherein pressurized water running through the hose that passes out of the exit ports causes the head to rotate and sweep about the pool cleaning the side-walls and the bottom surface and agitates water in the pool allowing for debris in the pool to move toward the drain and skimmer. The hose has a first short section of approximately one foot located between the inlet jet port connector and the means for swiveling, and a second longer section having a length of approximately the longest dimensional length of the pool located between the means for swiveling and the cleaning head. Floats can be attached on the second hose section can have selectively positioned floats for raising portions of the hose, and wear rings for protecting the hose from wear and tear when the hose rubs against the side-walls and bottom pool surface. A screen cage can be used within the cleaning head for housing a chlorine tablet, so that water passing through the head is chlorinated before passing into the pool. Second and third embodiments include brush sleeves about the cleaning heads and wear rings.

Typical pools rely on only the one side skimmer and a single drain to pass the pool water to the pool pumps. Furthermore, incoming water that is chlorinated by chlorinators at the pool pump only pass into the pool through the selected outlets in the pool walls. Thus, there are inherent "dead spots" in the pool where water is not circulating and where there is no fresh incoming chlorinated water. The sweeping action of the novel invention moves chlorinated water to the total pool so that there are no "dead spots" in the pool.

A typical 15' by 30' pool with a single pool pump can be run approximately 4 to approximately 5 hour per day with the subject invention instead of the approximately 8 to 10 hours per day that is recomended by most pool pump companies to thoroughly circulate and clean the water throughout the pool. Thus, using the subject invention can give a power cost savings of running the pool pump of up to approximately 50%. The ½ cost of the electric bill over the course of a year would be substantial to users of the invention.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
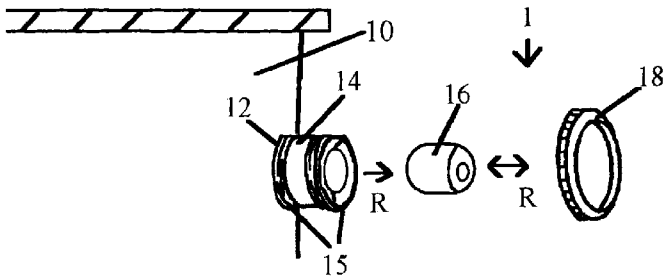
Fig. 1 Prior Art
FIG. 1 shows a standard type water jet inlet port for a standard swimming pool.

FIG. 1 shows a standard type water jet inlet port 12 for a standard swimming pool 1. The invention shown in FIGS. 2–4 can attach directly to inlet port 12. Typically, a jet inlet port 12 has a threaded opening 12 which mateably attaches to a threaded end 15 of a double threaded end bushing 14. Inside socket indented interior portion of bushing 14 can be a hollow plastic bearing "eye ball" 16, which is held in place by an exterior mounted ring which threads onto second threaded end 15 of bushing 14. The screwable members can be rotatably removed in the direction of arrow R in order to mount the novel invention 100 shown in FIGS. 2–4.

Figure 2:
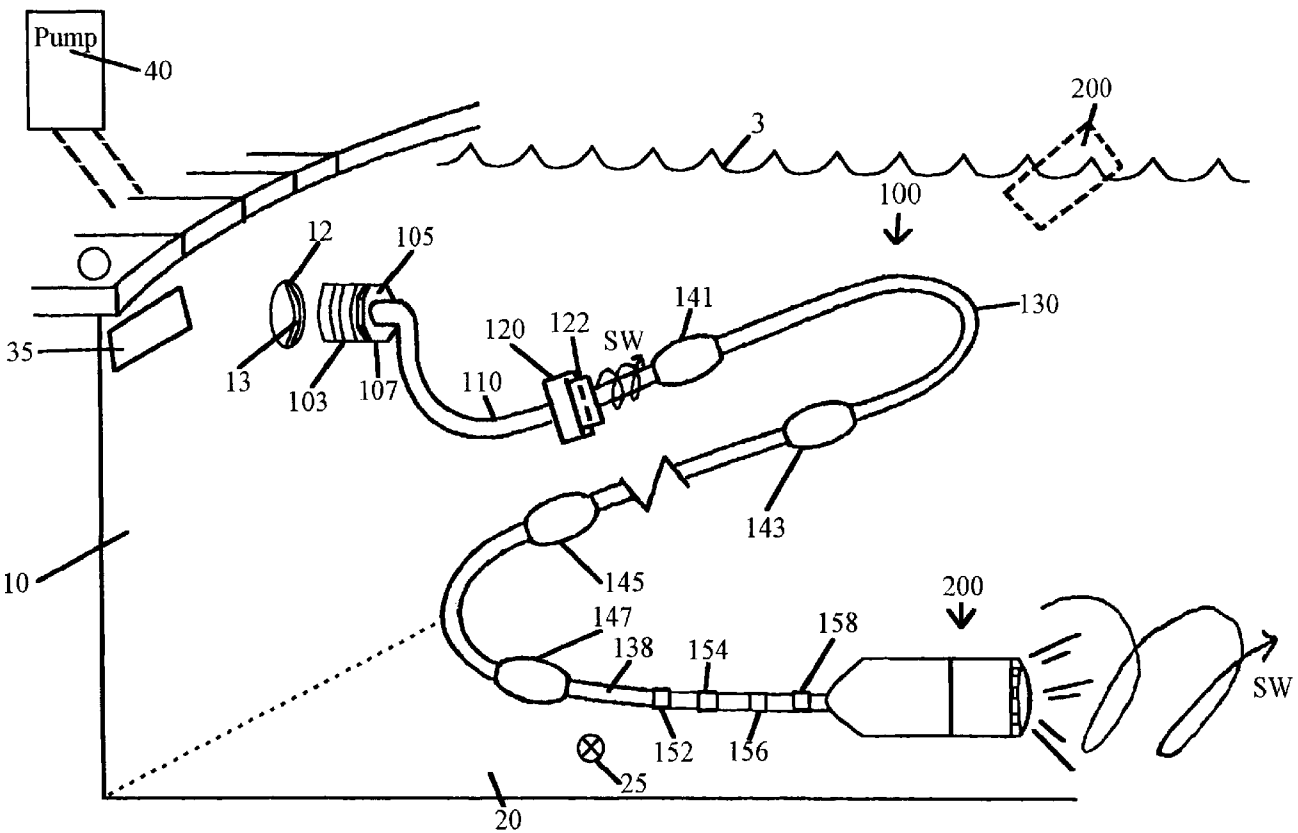
FIG. 2 is a perspective view of a first embodiment of the novel pool sweep cleaning apparatus.
Figure 3A:
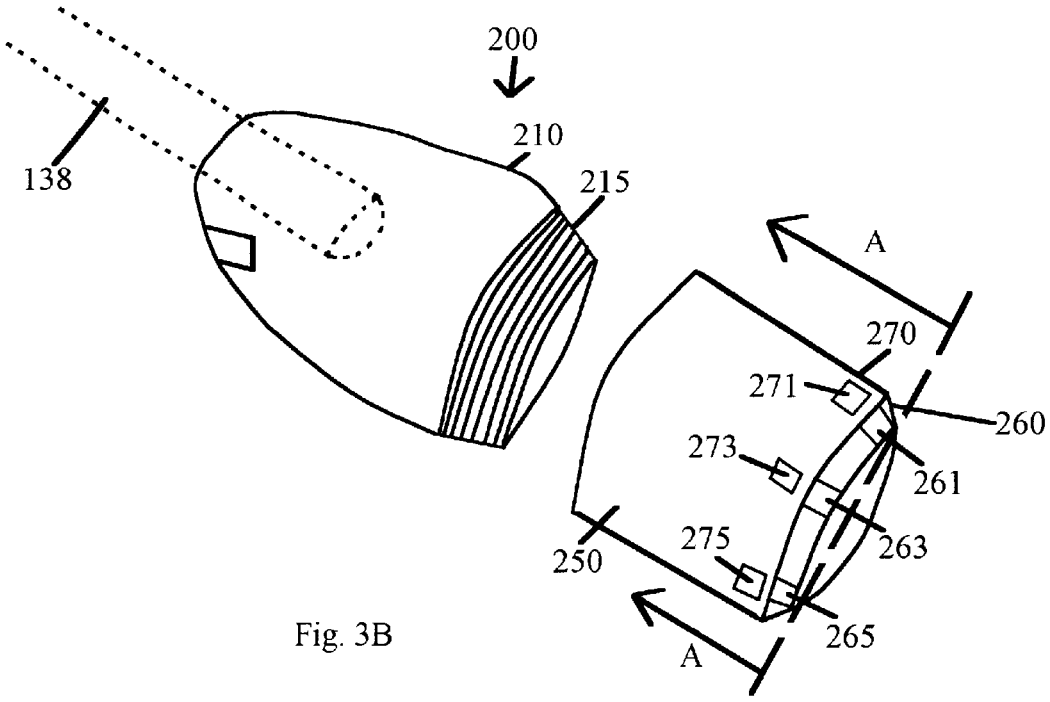
FIG. 3A is an exploded view of the novel cleaning head used with cleaning apparatus of FIG. 2.
Figure 3B:
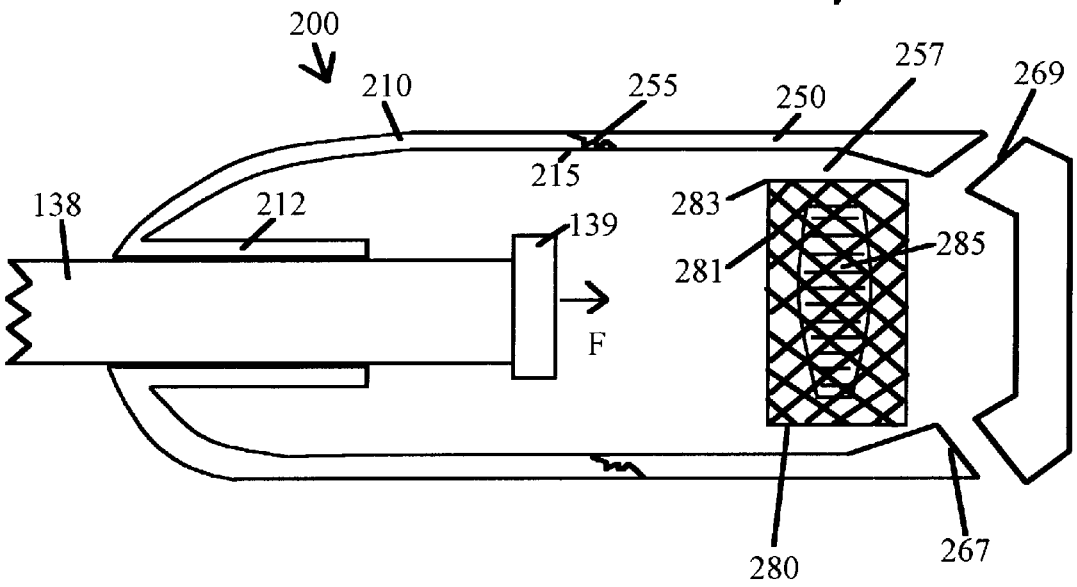
FIG. 3B is a cross-sectional view of the cleaning head of FIG. 3A along arrow 3B—3B.

FIG. 2 is a perspective view of a first embodiment 100 of the novel pool sweep cleaning apparatus. Referring to FIG. 2, invention 100 includes hollow plastic coupler 105 having a threaded male base 103 for mateably threading into threads 13 of jet inlet port 12 of the side-wall 10 in the swimming pool. A first flexible hose section 110 approximately one foot long having a diameter of approximately 2 to approximately 4 inches, can be made of plastic, nylon, rubber, combinations, thereof and the like, connects at one end to coupler 105 and the second end to swivel connector 120, which can be a rotatable bearing connection such as but not limited to the one shown in U.S. Pat. No. 3,872,533, which is incorporated by reference. Second side 122 of swivel connector 120 is free to rotate in the direction of arrow SW(the water passing through the invention and passing out the angled exit ports in the head 200 is shown in FIGS. 3A–3B, allows head 200 and hose section 130 to rotate). Although, the arrows SW indicate a clockwise rotation, the angles of the exit ports in FIGS. 3A–3B can be such as to cause a counter-clockwise rotation of the head 200 and hose section 130.

Attached to swivel side 122 of swivel coupler 120 is a second section of hose 130(made of similar material to the first hose section 110) which can have a length of approximately 20 to approximately 50 feet, which would generally depend on the longest length dimension of the swimming pool. For example, if a rectangular pool has a longitudinal length of 30 feet, second hose section 130 can have a length of approximately 30 feet, and so on. Wrapped about the exterior of second hose section 130 can be floats 141, 143, 145 and 147, which can be hollow air filled plastic, closed cell foam, and the like. The floats 141, 143, 145, 147 allow for the sweeping invention 100 to have full mobility about the pool so that all the side-walls 10 of the pool l(only one is shown here) and the bottom surfaces 20 can all be cleaned by the invention. Between last float 147 and head 200 is a section of second hose 138 which can have a length of approximately 6 to approximately 10 feet depending on the deepest depth of the pool. On section 138 can be wear rings 152, 154, 156 and 158, that each can be formed from PVC material and the like. The purpose of wear rings 152, 154, 156, 158 is to prevent wear and tear on hose 138 caused by the hose 138 rubbing against exterior surfaces of the side-walls 10 and bottom surfaces 20 of the pool. Although, not shown, these wear ring sleeves 152, 154, 156, 158 can also be applied to other sections of hose 110, and 130 to relieve those sections from wear and tear caused by the rubbing action against sidewalls 10 and bottom surface 20.

FIG. 3A is an exploded view of the novel cleaning head 200 used with cleaning apparatus 100 of FIG. 2. FIG. 3B is a cross-sectional view of the cleaning head 200 of FIG. 3A along arrow 3B—3B. Referring to FIGS. 3A–3B, cleaning head 200 includes base portion 210 which screwably attaches at one threaded end 215 to to the interior threaded end 255 of exterior cap 250. Base portion 210 has an interior molded stem 212 which wraps about hose end 138, a raised ridge about the end of hose 138 can hold hose end 138 from sliding out of stem 212. Inside of cap 250 is a molded seat 257 for housing a screened cage housing 280 for supporting a chlorine tablet 285 therein. One side of screened cage housing 280 can be a cage door 281 with hinge 283, which allows the door 281 to snap closed over the housing 280 when changing tablet 285. Fluid flow passing in the direction of arrow F passes through cage housing 280 chlorinating water coming from jet inlet port 12(shown in FIG. 2). Although chlorine tablets are well known to be used, other types of chemical releasing cleaning agents, can be used instead.

Referring to FIGS. 3A–3B, eight sets of fluid through-holes 261, 263, 265, 267, 269, 271, 273, 275 which each can be cut at an approximately 45 degree angle into an upper outer edge 260, and end 270 of cap 250. Both the angle of the through-holes and the position of the through-holes together with the fluid flow F coming from the hose 110, 130 cause the head and hose section 130 to rotate in the direction of SW shown in FIG. 2.

Figure 4:
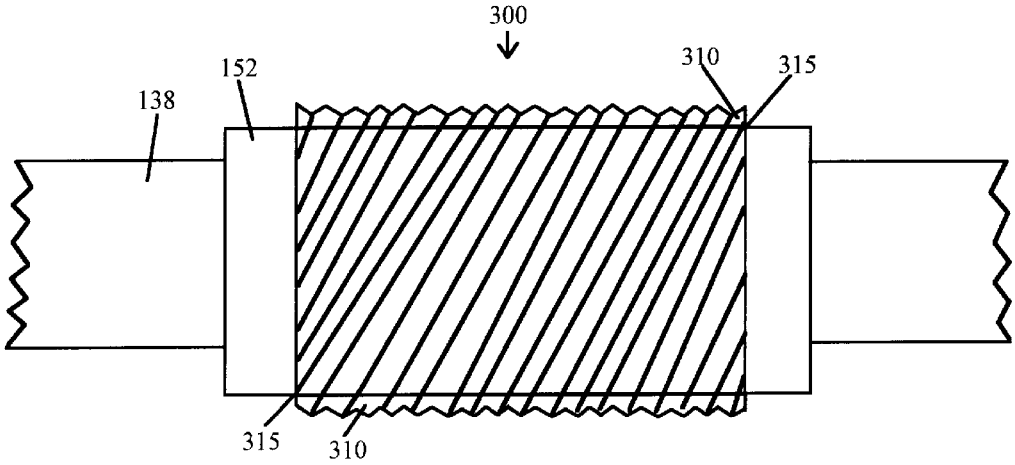
FIG. 4 is a second embodiment of using a sleeve brush pad attachment with the wear rings on the hoses of FIG. 2.

FIG. 4 is a second embodiment 300 of using a sleeve brush pad attachment 310 with the wear ring 152 on the hose 138 of FIG. 2. Sleeve brush pad attachment 310 can be a bristle brush material such as nylon bristles, plastic bristles, and the like, on a rubber type sleeve base 315 which tightly fits about wear ring 152. The other wear rings 154, 156, and 158 shown in FIG. 2 can also use the attachment 310. Alternatively, the attachment 310 can be a scrubber type scouring pad material such as those formed from nylon threads, plastic, and the like. The swivel action of hose 138, allows the brush attachment 310 to rotate about side-wall 10 and bottom surfaces 20 that are being cleaned. The brushes can also be attached directly about the hose 138 without the wear ring 152, so that the cylindrical brush both cleans the pool surface and protects the hose from wear and tear.

Figure 5:
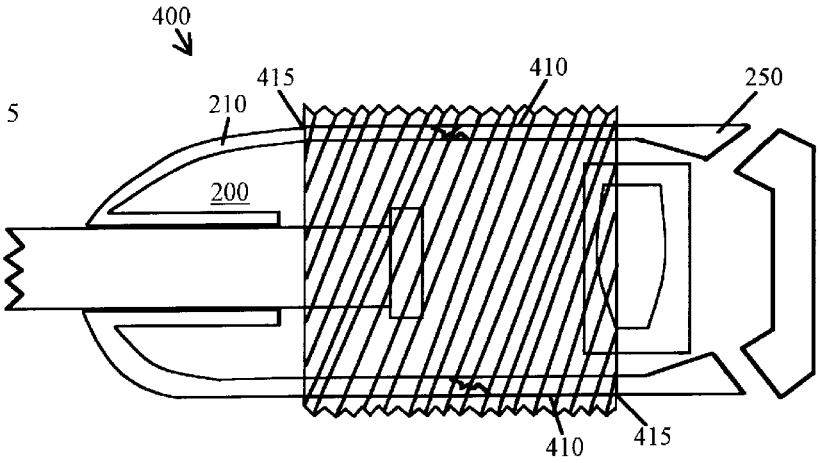
FIG. 5 is a third embodiment of a sleeve brush pad attachment on the cleaning head of FIG. 2.

FIG. 5 is a third embodiment 400 of a sleeve brush pad attachment 410 on the cleaning head 200 of FIG. 2. Sleeve brush pad attachment 410 can be a bristle brush material such as nylon bristles, plastic bristles, and the like, on a rubber type sleeve base 415 which tightly fits about cleaning head 200. Alternatively, the attachment 410 can be a scrubber type scouring pad material such as those formed from nylon threads, plastic, and the like. The swivel action of hose 138, allows the brush 410 to rotate about side-wall 10 and bottom surfaces 20 that are being cleaned.

The operation of the novel invention will now be described in reference to FIGS. 1–5, During operation, the head 200 and hoses 110, 130 go in a sweeping pattern across the bottom surfaces 20 and side-wall surfaces 10 of the pool 1, so that the brushes 310, 410 rotate and scrub those surfaces. The constantly moving hoses 110, 130 and head 200 further agitate the water causing debris to move towards the skimmer 35 and drain 25 of the pool 1 which increases the efficiency of filtering both the pool water and debris off the side-walls 10, and bottom surfaces 20 by just using the regular pump 40 running in the pool 1. In operation, the head 200 can move in a sweep pattern through the entire pool 1, and at times can rise to the surface 3 of the pool 1 so that the head 200' broaches above the water surface 3 causing a entertaining spectacle to pool patrons.

Unlike the prior art devices, the invention 100 can be used with swimmers in the pool 1, and add to the entertainment and enjoyment of pool patrons.

Although, FIGS. 4 and 5 show brushes being used separately on the wear rings and the cleaning head, the brushes can be simultaneously used on both the wear rings and the cleaning head in operation.

The subject invention can entirely be formed from injection molded plastic, and the like.

The novel cleaning head and/or the hose can be colored bright colors such as red, yellow, blue, green, rainbow colors, and the like, so as to be clearly visible to pool patrons, and to add an extra aestetic effect. For example, applying rainbow colors to the cleaner head and/or the hose will provide a twirling illusion effect thereof.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A sweep cleaning apparatus for swimming pools, comprising:

a hose having a first section and a second section;

a connector for attaching one end of the first section of the hose to a water inlet port in a swimming pool having a drain, side-walls and a bottom surface, both the first section of the hose and the second section of the hose being freely movable beyond the one end of the first section of the hose that is connected to the water inlet port;

means for causing the second section of the hose to swivel relative to the first section of the hose;

float means attached to the second section of the hose; and a cleaning head having through-hole exit ports, wherein pressurized water running through the hose that passes out of the exit ports causes the head to rotate and sweep about the pool cleaning the side-walls and the bottom surface and agitates water in the pool allowing for debris in the pool to move toward the drain.

2. A sweep cleaning apparatus for swimming pools, comprising:

a hose;

a connector for attaching one end of the hose to a water inlet port in a swimming pool having a drain, side-walls and a bottom surface, the hose being freely movable beyond the one end of the hose that is connected to the water inlet port;

a cleaning head having through-hole exit ports, wherein pressurized water running through the hose that passes out of the exit ports causes the head to sweep about the pool cleaning the side-walls and the bottom surface in the pool; and an enclosure within the cleaning head for housing a chlorine tablet, wherein chlorine from the chlorine tablet is released from the cleaning head into the swimming pool.

3. The sweep cleaning apparatus of claim 2, wherein the enclosure includes:

a screen cage.

4. A sweep cleaning apparatus for swimming pools, comprising:

a hose having a first section having a length of approximately one foot, and a second section, and the second section having a length of approximately the longest longitudinal length of the pool;

a connector for attaching one end of the first section of the hose to a water inlet port in a swimming pool having a drain, side-walls and a bottom surface, both the first section of the hose and the second section of the hose being freely movable beyond the one end of the first section of the hose that is connected to the water inlet port;

means for causing the second section of the hose to swivel relative to the first section of the hose; and a cleaning head having through-hole exit ports, wherein pressurized water running through the hose that passes out of the exit ports causes the head to sweep about the pool cleaning the side-walls and the bottom surface in the pool.

* * * * *